United States Patent [19]

Watanabe et al.

[11] Patent Number: 4,529,993

[45] Date of Patent: Jul. 16, 1985

[54] HEAT SENSITIVE TRANSFER MEDIUM

[75] Inventors: Hideo Watanabe; Nobuhiro Takigawa; Minoru Hakiri; Kanjirou Kawasaki, all of Numazu; Keishi Kubo, Yokohama, all of Japan

[73] Assignee: Ricoh Co., Ltd., Tokyo, Japan

[21] Appl. No.: 617,773

[22] Filed: Jun. 6, 1984

[30] Foreign Application Priority Data

Jun. 15, 1983 [JP] Japan ..... 58-107243

[51] Int. Cl.[3] ..... B41M 5/22

[52] U.S. Cl. ..... 346/208; 346/207; 346/209; 346/214; 427/150; 427/151

[58] Field of Search ..... 346/207, 208, 209, 214; 427/150, 151; 428/480, 481, 482

[56] References Cited

FOREIGN PATENT DOCUMENTS

| | | | |
|---|---|---|---|
| 2526717 | 11/1983 | France | 346/208 |
| 6162690 | 12/1981 | Japan | 346/208 |
| 116690 | 7/1982 | Japan | 346/208 |

*Primary Examiner*—Bruce H. Hess

*Attorney, Agent, or Firm*—Flynn, Thiel, Boutell & Tanis

[57] ABSTRACT

The heat sensitive transfer medium according to the present invention is characterized in that it comprises a transfer sheet having a transfer layer consisted essentially of a leuco-dye color former and a receiving sheet having a receiving layer consisted essentially of a developer for said leuco-dye and a binder and that said transfer layer further contains 0.01 to 1 part by weight of polyester resin which has a melting point of 50° to 130° C. and a repetition unit represented by the formula:

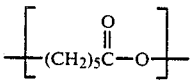

together with 0.01 to 1 part by weight of a porous filler which has an oil absorption of 50 ml or more/100 g, respectively per part by weight of said leuco-dye.

10 Claims, No Drawings

HEAT SENSITIVE TRANSFER MEDIUM

BACKGROUND OF THE INVENTION (a) Field of the Invention

The present invention relates to a heat sensitive transfer medium for use in thermographic recording which comprises combining a color former-containing transfer sheet with a developer-containing receiving sheet.

(b) Description of the Prior Art

As the heat sensitive transfer medium for use in thermographic recording, there have hitherto be known the one which comprises a transfer sheet formed by providing a heat-sublimable dye layer on a substrate and a receiving sheet which receives a dye image sublimed and transferred from said transfer sheet by heat-printing from the back (the substrate surface) of the transfer sheet, and the one which comprises combining a transfer sheet formed by providing a heat-fusible material and pigment or dye-containing transfer layer on a substrate with a receiving sheet which receives an image fused and transferred from said transfer sheet by heat-printing from the back of the transfer sheet. The former transfer medium is defective in that due to the use of the heat-sublimable dye, the dye image on the receiving sheet is inferior in preservability and consequently there is a necessity of overcoating the transferred image, while the latter transfer medium is defective in that because of having the transfer layer formed by dispersing pigment or dye in the heat-fusible material, when a large amount of pigment is contained in said layer in order to obtain a high density image, the transfer efficiency deteriorates, whereby it becomes difficult to obtain a high density image, and when using a large amount of heat-fusible material in order to improve the heat sensitivity, furthermore, as the result of said large amount of heat-fusible material transferring on the side of the receiving sheet, the separation of the transfer sheet from the receiving sheet can not be done smoothly to cause the fine line image area to lack definition.

On the other hand, a heat sensitive transfer medium (for instance, such as the medium disclosed in British Pat. No. 1,053,905), which comprises supporting on a substrate separately two kinds of materials, for instance the color forming agent such as benzoindolinospyropyran and the developer such as phenolic compound, which form color by their mutual thermal reaction, and contacting these supporting layers (transfer layer and receiving layer) facing each other to effect heat-printing, is also known, but the medium of this type is observed to be defective in that since the medium of this kind is of reaction type, if the transfer layer transfers only toward the receiving layer at the time of facing contact, the color formation is not effected to the full, thereby producing a low density image, while if the heating conditions are effected at higher temperature and for longer times in order to promote the sufficient reaction, the image on the receiving sheet surely becomes a high density image, but the color forming reaction proceeds also on the transfer sheet to thereby cause image formation.

We previously proposed, as the heat sensitive transfer medium which had improved the above mentioned drawbacks, the one prepared by incorporating a large amount of oil-absorptive porous filler in the receiving layer formed on the receiving sheet. The heat sensitive transfer medium of this type surely can obtain a high density image by a large number of transfer, but is still not satisfactory in respect of the uniformity of image density.

In addition, it was difficult for the above mentioned conventional heat sensitive transfer mediums to obtain images which are superior in the mechanical strength such as friction resistance, abrasion resistance and the like.

SUMMARY OF THE INVENTION

The object of the present invention is to provide a heat sensitive transfer medium which is capable of obtaining a high density image with superiority in respect of high sensitivity as well as preservability, mechanical strength and the like over the aforesaid various heat sensitive treanfer medium and further is capable of obtaining a uniform image density even when subjected to many repeated transfer operations.

According to the present invention, there is provided a heat sensitive transfer medium which comprises a transfer sheet having a transfer layer consisted essentially of a leuco-dye color former and a receiving sheet having a receiving layer consisted essentially of a developer for said leuco-dye and a binder, and said transfer layer further contains 0.01 to 1 part by weight of polyester resin which has a melting point of 50°–130° C. and a repetition unit represented by the formula

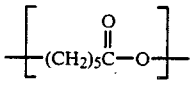

together with 0.01 to 1 part by weight of a porous filler which has an oil absorption of 50 ml or more/100 g, respectively per part by weight of said leuco-dye.

DETAILED DESCRIPTION OF THE INVENTION

The heat sensitive transfer medium according to the present invention is designed so that it comprises superimposing the receiving sheet on the transfer sheet so that the receiving layer of said receiving sheet may contact the transfer layer of said transfer sheet and a desired color image is formed on the surface of the receiving sheet by heat-printing from the back of the transfer sheet or the back of the receiving sheet. However, since the present invention, as stated above, has incorporated the porous filler having a specific oil absorption in the transfer layer of the transfer sheet, transfer of the dye component from the transfer layer to the receiving layer is uniformed and consequently the greater part of the dye is held in the transfer layer and a small amount of the dye transfers at every transfer operation. Accordingly, when using the heat sensitive transfer medium according to the present invention, in case one and the same transfer sheet is utilized many times, there can be obtained a uniformed density color image on the receiving sheet.

The porous filler suitably used in the present invention has an oil absorption of at least 50 ml/100 g (according to JIS K5101), preferably 150 ml or more/100 g. When the oil absorption is less than 50 ml/100 g, the object of the present invention can not be achieved to the full. The percentage of the porous filler contained in the transfer layer is 0.01 to 1 part by weight, preferably 0.03 to 0.5 part by weight per part by weight of the leuco-dye. As the concrete examples of the porous fillers used in the present invention there can be enumerated inorganic or organic fine powders of silica, aluminum silicate, alumina, aluminum hydroxide, magnesium hydroxide, urea-formaldehyde resin, styrene resin and the like.

In connection with the use of said porous filler, the present invention makes the transfer layer further contain the polyester resin having the repetition unit represented by said formula and having a melting point in the range of 50° to 130° C. in order to further improve the uniformity in transfer image density. Said polyester resin can be obtained by polymerizing ε-caprolactone in a usual manner. As the polyester resin contained in this transfer layer has a low melting point, it acts to lower the melt viscosity of the transfer layer when transferring the leuco-dye from the transfer layer to the receiving layer by heat transfer and elevate the heat sensitivity and simultaneously it exhibits the effect of tightly holding and fixing the leuco-dye (or transfer layer) on the transfer sheet to thereby enhance the friction resistance and abrasion resistance of the transfer layer, namely the image. In the case of resins such as polystyrene, vinyl chloride -vinyl acetate copolymer and the like, which have a low melting point but is inferior in mechanical strength, there take place partial peeling of the transfer layer and disconnect of the leuco-dye from the transfer layer when frictional force is applied, whereby the transfer layer can not exhibit its performance to the full and a uniform, high density image can not be obtained. In the case of the present invention, such disadvantages can be avoided.

The polyester resin used in the present invention must not always be used singly, but may be used concurrently with other resins provided that the object of the present invention is not especially hindered thereby. As the other resins used herein there can be enumerated styrene resin, polyethylene, polypropylene, acrylic resin, vinyl chloride resin, polyamide, polycarbonate, epoxy resin, phenol resin, vinyl acetate resin and the like. The amount of polyester resin used in the transfer sheet of the present invention is in the range of 0.01 to 1 part by weight per part by weight of the leuco-dye. When this resin amount is less than 0.01 part by weight, the binding capacity of said resin to the transfer sheet is weakened, whereby it becomes impossible to let the substrate hold the leuco-dye and the porous filler thereon with a sufficient fixing capacity. When said resin amount is over 1 part by weight, on the other hand, the heat sensitivity of the product lowers and the resulting transfer image density deteriorates. In the case of the present invention, the resin amount used preferably should be in the range of 0.05 to 0.5 part by weight in the light of obtaining a uniform image density through a large number of repeated transfer operations. As the method for applying resin to the substrate, there may be employed any one of solvent coating and hot melt coating.

The transfer sheet used in the present invention comprises the substrate such as paper, synthetic paper, plastic film or the like and a transfer layer, superposed on the substrate, which is consisted of the principal ingredient, leuco-dye color former and auxiliary ingredients added thereto such as a specific porous filler and a specific polyester resin.

As the leuco-dye used in this instance, there is applicable any one of those which have usually been used for pressure sensitive papers and heat sensitive papers, and the leuco-dye of triphenylmethane type, fluorene type, phenothiazine type, auramine type, or spiropyran type is preferably applicable. These leuco-dyes will be concretely enumerated hereinafter.

3,3-bis(p-dimethylaminophenyl)phthalide,
3,3-bis(p-dimethylaminophenyl)-6-dimethylaminophthalide (its another name is Crystal Violet lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-(N,N-diethylamino)-5-methyl-7-(N,N-dibenzylamino)fluoran,
3-dimethylamino-5,7-dimethylfluoran,
3-diethylamino-7-chlorofluoran,
3-diethylamino-7-methylfluoran,
3-diethylamino-7,8-dibenzofluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-{N-(3'-trifluoromethylphenyl)amino}-6-diethylaminofluoran, 2-{3,6-bis(diethylamino)-9-(o-chloroanilino)xanthyl benzoic acid lactam}.
3-diethylamino-6-methyl-7-(m-trichloromethyloanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran, benzoyl leuco Methylene Blue,
6'-chloro-8'-methoxy-benzoindolino-pyrrilospiran,
6'-bromo-3'-methoxy-benzoindolino-pyrrilospiran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide, and
3-(2'-methoxy-4'-dimethylaminophenyl)-3-(2'-hydroxy-4'-chloro-5'-methylphenyl)phthalide.

In the present invention, the above mentioned leuco-dyes are normally used in amounts ranging from about 0.3 to 30 g, preferably 0.5 to 20 g, per square meter of the substrate.

The receiving sheet used in the present invention is formed by mounting, on the substrate such as paper, synthetic paper, plastic film or the like, a receiving layer containing the developer for said leuco-dye together with the binder of common use. In this case, as developers there are used electron acceptable substances such, for instance, as phenolic substances, organic acids or salts or esters thereof. In the light of practicality, those having a melting point of 200° C. or less are used preferably. Concrete examples of the developers suitably used in the present invention will be shown hereinafter. In this connection, it is to be noted that the bracketed numerals denote melting points.

4-tert-butylphenol (98), 4-hydroxydiphenyl ether (84), 1-naphthol (98), 2-naphthol (121), methyl 4-hydroxybenzoate (131), 4-hydroxyacetophenone (109), 2,2'-dihydroxydiphenyl ether (79), 4-phenylphenol (166), 4-tert-octylcatechol (109), 2,2'-dihydroxydiphenyl (103), 4,4'-methylenebisphenol (160), 2,2'-methylene-bis(4-chlorophenol) (164), 2,2'-methylene-bis(4-methyl-6-tert-butylphenol) (125), 4,4'-isopropylidene-diphenol (156), 4,4'-isopropyrylidene-bis(2-chlorophenol) (90), 4,4'-isopropylidene-bis(2,6-dibromophenol) (172), 4,4'-isopropylidene-bis(2-tert-butylphenol) (110), 4,4'-isopropylidene-bis(2-methylphenol) (136), 4,4'-isopropylidene-bis(2,6-dimethylphenol) (168), 4,4'-sec-butylidenediphenol (119), 4,4'-sec-butylidene-bis(2-methylphenol)(142), 4,4'-cyclohexylidenediphenol (180), 4,4'-cyclohexylidene-bis(2-methylphenol) (184), salicylic acid (163), metatolyl salicylate (74), phenacyl salicylate (110), methyl 4-hydroxybenzoate (131), ethyl 4-hydroxybenzoate (116), propyl 4-hydroxybenzoate (98), isopropyl 4-hydroxybenzoate (86), butyl 4-hydroxybenzoate (71), isoamyl 4-hydroxybenzoate (50), phenyl 4-hydroxybenzoate (178), benzyl 4-hydroxybenzoate (111), cyclohexyl 4-hydroxybenzoate (119), 5-hydroxysalicylic acid (200 ), 5-chlorosalicylic acid (172), 3-chlorosalicylic acid (178), thiosalicylic acid (164), 2-chloro-5-nitrobenzoic acid (165), 4-methoxyphenol (53), 2-hydroxybenzylalcohol (87), 2,5-dimethylphenol (75), benzoic acid (122), orthotoluylate (107), metha-toluylic acid (111), paratoluylic acid (181), orthochlorobenzoic acid (142), metha-oxybenzoic acid (200), 2,4-dihydroxyacetophenone (97), resorcinol monobenzoate (135), 4-hydroxybenzophenone (133), 2,4-dihydroxybenzophenone (144), 2-naphthoic acid (184), 1-hydroxy-2-naphthoic acid (195), ethyl 3,4-dihydroxybenzoate (128), phenyl 3,4-dihydroxybenzoate (189), 4-hydroxypropiophenone (150), salicyl salicylate (148), monobenzyl phthalate (107), bis(4-hydroxyphenylmercapto)methane (55), 1,2-bis(4-hydroxyphenylmercapto)ethane (173), 1,3-bis(4-hydroxyphenylmercapto)-propane (82), 1,4-bis(4-hydroxyphenylmercapto)butane (182), 1,5-bis(4-hydroxyphenylmercapto)pentane (98), 1,6-bis(4-hydroxyphenylmercapto)hexane (166), 1,3-bis(4-hydroxyphenylmercapto)acetone (74), 1,5-bis(4-hydroxyphenylmercapto)-3-oxapentane (93), 1,7-bis(4-hydroxyphenylmercapto)-3,5-dioxaheptane (108), and 1,8-bis(4-hydroxyphenylmercapto)-3,6-dioxaoctane (100).

Further, said developers can include zinc chloride. This zinc chloride developer can produce a transferred color image which is superior in the anti-plasticizing property and the anti-solvent property.

As the usual binders used concurrently with the developers, on the other hand, there can be enumerated PVA, ethyl cellulose, vinyl chloride resin, vinyl acetate resin, hydroxyethylcellulose, polyvinyl pyrrolidone, acrylic resin, polypropylene, polyethylene, polycarbonate, phenol resin and the like. The amounts of said binders used properly is in the range of about 0.1 to 1.0 part by weight per part by weight of the developer.

It is also preferable for the present invention to contain in said receiving layer the porous filler having oil absorption of 50 ml or more/100 g as occasion arises. The contents of the porous filler in the receiving layer are in the range of 0.01 part by weight or more, normally 0.05 to 10 parts by weight and preferably 0.1 to 3 parts by weight per part by weight of the developer.

In the present invention, furthermore, it is possible to add various heat-fusible materials having a melting point of 200° C. or less, preferably 150° C. or less to the transfer layer and also the receiving layer as occasion arises. The amount of this material used is in the range of 0.1 to 50 parts by weight per part by weight of the leuco-dye. As the heat-fusible materials, there can be enumerated wax, low molecular weight polyethylene, lauric acid amide, behenic acid amide, stearic acid amide, N-stearylbenzamide, 4-cyanophenyl benzoate, 4-methoxyphenyl benzoate, phenyl 4-benzoyloxy benzoate and the like.

The transfer layer formed on the surface of the transfer sheet used in the present invention may be the one provided uniformly covering the whole surface of the substrate, the so-called non-figured (non-imaged) one, or may be the previously figured one. The transfer sheet having a non-figured transfer layer can be obtained only by applying a transfer layer-forming liquid on the surface of the substrate. On the other hand, the transfer sheet having a figured transfer layer can be obtained by applying a transfer layer-forming liquid in a desired imagewise (including characters) manner on the surface of the substrate by using the letterpress printing method or gravure method, or can be obtained by superposing a suitable substrate face such as paper, synthetic paper, plastic film or the like on the surface of the non-figured transfer layer of said transfer sheet, pressing same imagewise from the substrate side or transfer sheet side by using a pressing means such as typewriter, tracer or the like or a heat-pressing means such as thermal head, hot pen or the like, and thus adhering the non-figured transfer layer of the transfer sheet imagewise on another suitable substrate surface.

In the case of effecting heat sensitive transfer by using the heat sensitive transfer medium according to the present invention where, for instance, the transfer sheet has the imagewise transfer layer, said transfer operation can be effected by superposing the receiving sheet on the face of this transfer layer so that the receiving layer of the receiving sheet may contact, and passing same between heating rollers. When using the transfer sheet having the non-figured transfer layer, in contrast, the transfer operation is carried out by superposing the receiving layer of the receiving sheet on the face of the transfer layer of the transfer sheet and heat-printing from the back of the transfer sheet directly by the use of a thermal printer, or the transfer operation is carried out by superposing the receiving layer of the receiving sheet on the face of the transfer layer of the transfer sheet, surface-contacting a black-inked original with the substrate of the transfer sheet, and heating the black image area of the original selectively to a high temperature by irradiation of infrared ray from the receiving sheet side (in this case, however, both the transfer sheet and the receiving sheet must be transparent to infrared ray).

The heat sensitive transfer medium as utilized in the present invention can readily obtain a multiplicity of copies by repeating the aforesaid operation using one and the same transfer sheet. When intending to obtain a multicolor copy, it can be achieved by preparing transfer sheets consisted essentially of different color leuco-dyes, for instance a transfer sheet consisted essentially of a blue leuco-dye and a transfer sheet consisted essentially of a red leuco-dye and forming a transfer image on one and the same receiving sheet by transfer, whereby a blue and red color image can be formed on one and the same sheet.

The heat sensitive transfer medium according to the present invention, by using in the transfer layer of the transfer sheet the leuco-dye as the primary ingredient and the porous filler having a specific oil absorption and the polyester resin having a specific melting point as auxiliary ingredients, can form an image having a high density as well as a superior preservability at a small amount of heat energy, and accordingly at a high sensitivity. Furthermore, the transfer medium of the present invention can produce a multiplicity of copies from one and the same transfer sheet and so is also economical. Still further, the copies obtained in this case are uniform in image density because transfer of the leuco-dye from the transfer layer of the transfer sheet to the receiving layer of the receiving sheet is uniform and when transfer is effected the dye is transferred little by little.

DESCRIPTION OF THE PREFERRED EMBODIMENTS

EXAMPLE 1

| Preparation of transfer sheet (A) | |
|---|---|
| 3-N—methyl-N—cyclohexylamino-6-methyl-7-anilinofluoran | 10 g |
| silica fine powder (oil absorption 145 ml/100 g) | 1 g |
| polyester resin [poly(ε-caprolactone)] (molecular weight: 10,000, melting point: 59° C.) | 2 g |
| methyl ethyl ketone | 100 g |

A composition comprising aforesaid ingredients was dispersed in a ball mill for 24 hours and thereafter was coated on the surface of a 15 μ-thick condenser paper by means of a wire bar and dried, thereby obtaining a transfer sheet (A) having a coat of 4 g/m$^2$.

| Preparation of receiving sheet (B) | |
|---|---|
| n-butyl 4-hydroxy benzoate | 20 g |
| silica fine powder (oil absorption 200 ml/100 g) | 10 g |
| polyvinyl alcohol | 3 g |
| water | 100 g |

A composition comprising aforesaid ingredients was dispersed in a ball mill for 24 hours and thereafter was coated on a wood free paper (35 g/m$^2$) surface and dried, thereby obtaining a receiving sheet (B) having a coat of 5 g/m$^2$.

The surface of thus obtained transfer sheet (A) was contacted with the surface of the thus obtained receiving sheet (B), and a heating energy of 1 mJ was applied on the back of the transfer sheet by using a thermal head to thereby obtain a black image having an image density of 1.20. Further, the above mentioned operation was repeated 10 times. The image density after that was 1.15. The transfer layer of the transfer sheet was subjected to the rub-off test 50 times under a load of 500 g, and thereafter a heating energy of 1 mJ was applied on the back of the transfer sheet by means of a thermal head. The obtained image density was 1.19 and lowering of the image density was not observed.

COMPARATIVE EXAMPLE 1

A transfer sheet was prepared by repeating the exactly same procedure as Example 1 except that the polyester resin contained in the transfer sheet was replaced by styrene resin (molecular weight 800, melting point 75° C.), and the thus prepared transfer sheet was subjected to the same operation as Example 1. As the result, the image density was 1.15 at the first time, the image density was 1.07 at the 10th time, the image density after the completion of the rub-off test was 0.74, and the mechanical strength of the comparative product was inferior to that of the product of the present invention. As is described above, the transfer sheet of the present invention is superior in the mechanical strength and heat sensitivity.

EXAMPLE 2

| | |
|---|---|
| 3-diethylamino-6-chlorofluoran | 15 g |
| magnesium hydroxide fine powder (oil absorption 100 ml/100 g) | 2 g |
| polyester resin [poly (ε-caprolactone)] (molecular weight: 40,000, melting point: 60° C.) | 1.5 g |
| styrene resin (molecular weight: 1,500, melting point: 100° C.) | 0.5 g |
| methyl ethyl ketone | 100 g |

A composition comprising aforesaid ingredients was dispersed in a ball mill for 24 hours and thereafter was coated on a 12 μ-thick polyester film by means of a wire bar and dried to prepare a transfer sheet having a coat of 5 g/m$^2$.

On the other hand, a composition comprising the following ingredients:

| | |
|---|---|
| n-nonyl para-hydroxybenzoate | 25 g |
| silica fine powder | 25 g |
| polyvinyl alcohol (10% aqueous solution) | 35 g |
| water | 100 g |

was dispersed for 24 hours and thereafter was coated on the surface of a wood free paper (35 g/m$^2$) by means of a wire bar and dried to prepare a receiving sheet having a coat of 5 g/m$^2$.

The thus obtained transfer sheet and receiving sheet were surface-contacted and supplied with a heating energy of 1 mJ by means of a thermal head to obtain a red image having an image density of 1.17. Further, the above mentioned operation was repeated 10 times. The image density after that was 1.13. The image density of 1.14 was obtained even after the rub-off test was repeated 50 times under a load of 500 g.

COMPARATIVE EXAMPLE 2

A transfer sheet was prepared by repeating the exactly same procedure as Example 1 except that the polyester resin of the transfer sheet was replaced by vinyl chloride-vinyl acetate copolymer (molecular weight: 7,500, melting point: 65° C.) and was subjected to the same operation with Example 2. As the result, the image density was 0.86 at the first time, the image density was 0.84 at the 10th time, and the image density after the completion of the rub-off test was 0.81. Accordingly, the control is inferior in heat sensitivity. As described above, the transfer sheet of the present invention is superior in respect of mechanical strengt and heat sensitivity.

EXAMPLE 3

| | |
|---|---|
| Crystal Violet lactone | 15 g |
| silica fine powder (oil absorption 300 ml/100 g) | 1 g |
| polyester resin [poly(ε-caprolactone)] (molecular weight: 70,000, melting point: 61° C.) | 2 g |
| methyl ethyl ketone | 100 g |

A composition comprising the above ingredients was dispersed in a ball mill for 24 hours, and thereafter applied on a 10 μ-thick condenser paper by means of a wire bar and dried to prepare a transfer sheet having a coat of 4 g/m$^2$. This transfer sheet was surface-contacted with the receiving sheet used in Example 2, then a heating energy of 1 mJ was supplied onto the same from a thermal head, and was subjected to the same operation as Example 2. As the result, the image density was 1.12 at the first time, the image density was 1.10 at 10th time, and the image density after the rub-off test was 1.10.

We claim:

1. A heat sensitive transfer medium which comprises a transfer sheet having a transfer layer consisting essentially of a leuco-dye color former and a receiving sheet having a receiving layer consisting essentially of a developer for said leuco-dye and a binder, wherein said transfer layer further contains 0.01 to 1 part by weight of polyester resin which has a melting point of 50° to 130° C. and a repetition unit represented by the formula:

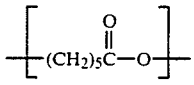

together with 0.01 to 1 part by weight of a porous filler which has an oil absorption of 50 ml or more/100 g, respectively, per part by weight of said leuco-dye.

2. A transfer medium according to claim 1 wherein said porous filler is an inorganic or organic fine powder selected from the group consisting of silica, aluminum silicate, alumina, aluminum hydroxide, magnesium hydroxide, urea-formaldehyde resin and styrene resin.

3. A transfer medium according to claim 1 wherein the amount of leuco-dye used is in the range of 0.3 to 30 g per square meter of the substrate.

4. A transfer medium according to claim 1 wherein the amount of binder contained in the receiving layer is about 0.1 to 1.0 part by weight per part by weight of the developer.

5. A transfer medium according to claim 1 wherein the developer is selected from the group consisting of an organic acid or its salt or ester and zinc chloride.

6. A transfer medium according to claim 5 wherein the melting point of the developer is 200° C. or less.

7. A transfer medium according to claim 1 wherein said porous filler is further contained in the receiving layer.

8. A transfer medium according to claim 1 wherein said transfer layer further contains a heat-fusible material having a melting point of 200° C. or less.

9. A transfer medium according to claim 1 wherein the receiving layer further contains a heat-fusible material having a melting point of 200° C. or less.

10. A transfer medium according to claim 1 wherein the developer is a phenolic substance.

* * * * *